US006375554B1

(12) United States Patent
Murray et al.

(10) Patent No.: US 6,375,554 B1
(45) Date of Patent: Apr. 23, 2002

(54) RETAINING MECHANISM FOR LAPPING DEVICE

(75) Inventors: Jeffrey Murray, Ellington; Jonathan Dooley, Bolton; Lawrence Wolfson, West Hartford, all of CT (US)

(73) Assignee: Gerber Coburn Optical Inc., South Windsor, CT (US)

( * ) Notice: Subject to any disclaimer, the term of this patent is extended or adjusted under 35 U.S.C. 154(b) by 0 days.

(21) Appl. No.: 09/452,591

(22) Filed: Dec. 1, 1999

(51) Int. Cl.[7] ..... B24B 41/00
(52) U.S. Cl. ..... 451/42; 451/509
(58) Field of Search ..... 451/42, 514, 515, 451/516, 921, 323, 325, 550, 61, 314, 317, 509, 508; 279/2.19, 2.24, 4.12

(56) References Cited

U.S. PATENT DOCUMENTS 2,747,343 A * 5/1956 Gellert ..... 451/509
5,157,880 A * 10/1992 Rotenberg et al. ..... 451/550
5,209,023 A * 5/1993 Bizer ..... 451/550
5,779,529 A * 7/1998 Bizer ..... 451/550
5,800,255 A * 9/1998 Hyslop et al. ..... 451/550
5,931,724 A * 8/1999 Perlov et al. ..... 451/41
6,244,941 B1 * 6/2001 Bowman et al. ..... 451/288

FOREIGN PATENT DOCUMENTS

| | | |
|---|---|---|
| EP | 0804999 A2 | 11/1997 |
| EP | 0974422 A1 | 1/2000 |
| GB | 1568038 | 5/1980 |
| GB | 2196886 A | 5/1988 |

* cited by examiner

*Primary Examiner*—Robert A. Rose
(74) *Attorney, Agent, or Firm*—Cantor Colburn LLP

(57) ABSTRACT

A quick change lap retaining device uses radially displaceable blades to engage a groove in the underside of a lap and thereby hold the lap in position. The device fails in the engaged position to prevent inadvertent movement of the lap. Removal of the lap occasioned by disengagement of the blades is preferentially by pneumatic drive but can also be manual.

10 Claims, 8 Drawing Sheets

RETAINING MECHANISM FOR LAPPING DEVICE

BACKGROUND OF THE INVENTION

1. Field of the Invention

The invention relates to the field of eyeglass lens production. More particularly, the invention relates to a device for retaining various laps for fining and polishing of lenses.

2. Prior Art

Ophthalmic and other types of lenses are typically produced from lens blanks of glass or plastic having two major surfaces, one of which is typically finished, and the other of which is unfinished. Cutting, fining, and polishing operations are performed on the unfinished surface of the lens blank by a machine responsive to data corresponding to a particular lens prescription. The cutting operations are usually accomplished by employing a ball mill for plastic lenses, or a grinder for glass lenses. These cutting operations generally create a lens surface closely approximating the shape of the finished lens. However, the cut surface of the lens blank is often rough and requires that subsequent fining and polishing operations be performed on the lens blank to achieve the requisite optical clarity.

The fining and polishing operations are ordinarily performed by engaging the cut surface of the lens blank with an abrasive surface having a shape that closely approximates the desired finished shape of the lens as defined by the lens prescription. This abrasive surface is referred to by those skilled in the pertinent art as a tool or "lap". During operation, the device to which the lens blank is mounted, moves the blank over the abrasive surface of the lap along a conforming contoured semi-spherical path, thereby fining and/or polishing the lens surface. Laps generally consist of two main components, a mounting surface or mandrel, and a removable abrasive pad that mounts on the mandrel and against which the lens blank is moved during fining and polishing operations. The shape of the mandrel must conform as closely as possible to the prescribed shape of the lens, therefore, different lens prescriptions require different laps to be used.

One drawback of prior art apparatuses is due to the mounting system for the various laps. Conventionally, laps are secured to a support by clamping a flange extending from the bottom edge of the lap. Clamping devices used include hydraulic, pneumatic and mechanical fasteners. All of these require a significant amount of time to install and therefore leave the art in need of a more time efficient yet reliable means of securing laps to the lap tower.

SUMMARY OF THE INVENTION

The above-identified drawbacks of the prior art are overcome or alleviated by the lap retaining mechanism of the invention.

The invention provides for quick change of laps and reliable failsafe retention thereof. This is beneficial in that many different laps are needed for the many different possible prescriptions for lenses.

The invention comprises a base through which a pair of shafts extend. The shafts are keyed to a pair of blades, one on each shaft. The blades rotate with the shafts because of the keyed relationship. The blades when not actuated (the failsafe condition) are rotated such that an outer aspect of each blade extends radially outwardly so that such outer aspect is received in a recess in a lap disposed on the lap tower to prevent separation of the lap from the tower. Upon actuation of a pneumatic, hydraulic, mechanical or electromechanical driver, a biasing means is overcome and the blades are retracted. In this condition the lap may be removed and replaced. Advantageously, the system provides a means for manual operation to be employed in the event that the mechanized drive is lost.

With the system of the invention significant time savings is realized during lens manufacture due to speedy lap changes.

BRIEF DESCRIPTION OF THE DRAWINGS

Referring now to the drawings wherein like elements are numbered alike in the several Figures.

DETAILED DESCRIPTION OF THE INVENTION

Figure 1:
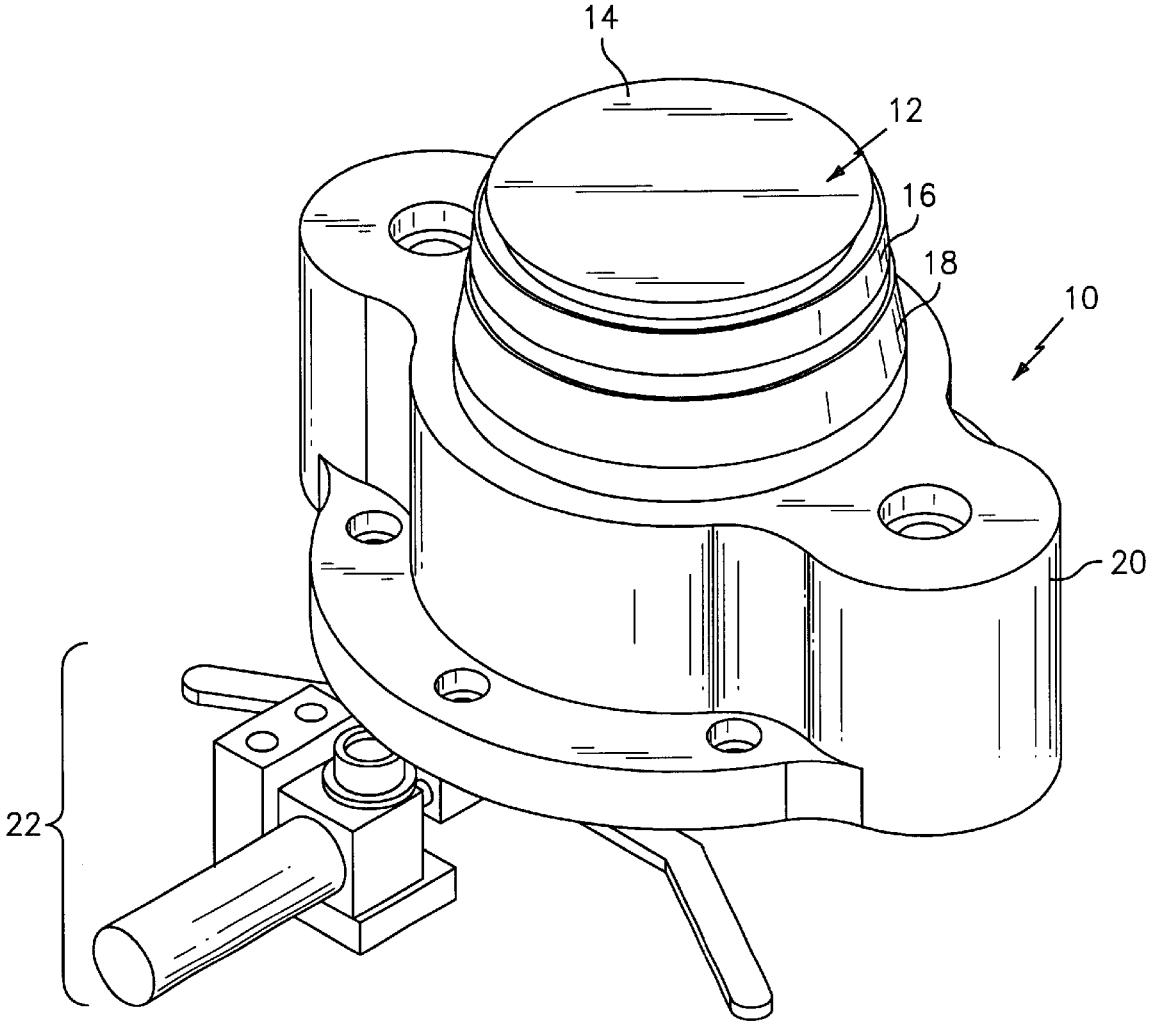
FIG. 1 is a perspective view of a lapping device in accordance with the present invention.
Figure 2:
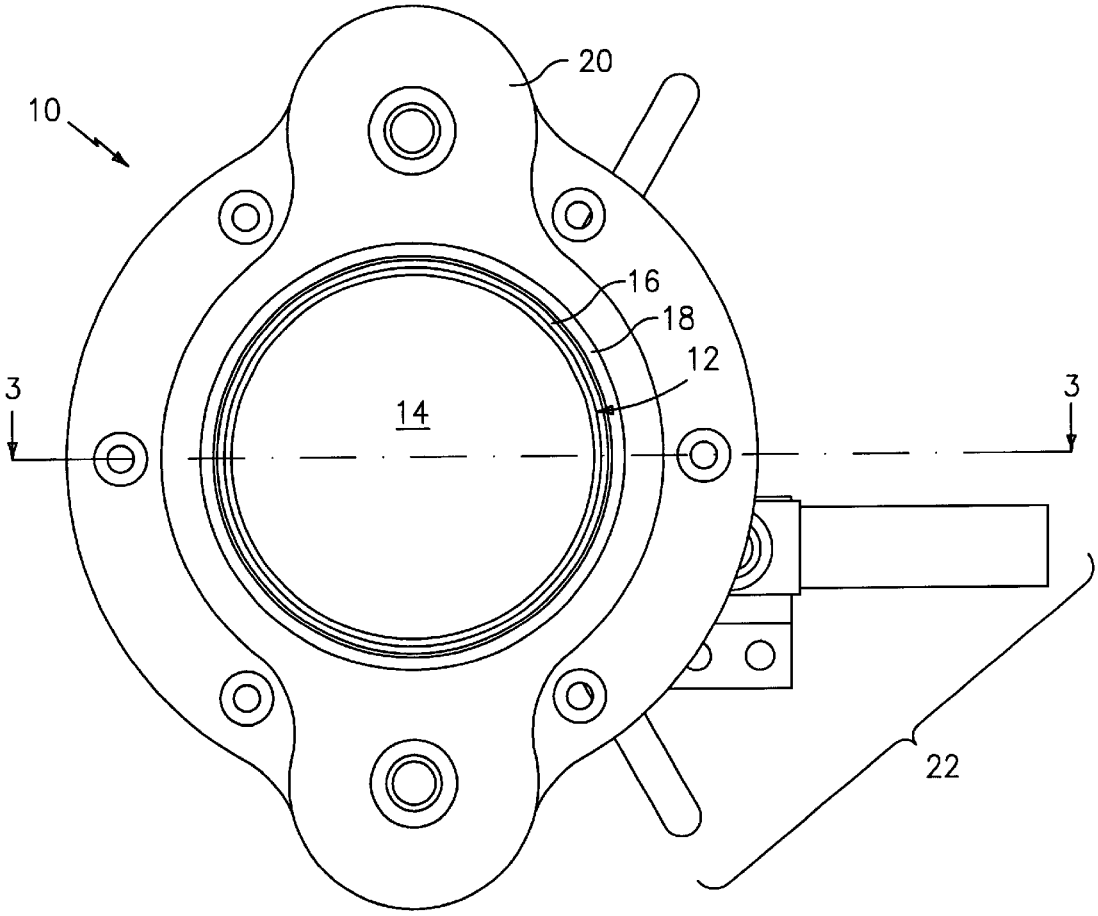
FIG. 2 is a top plan view of the lapping device of FIG. 1.

Referring to FIGS. 1 and 2, an exterior perspective view and top plan view of the retaining mechanism for a lapping device 10 are illustrated. It will be appreciated that a lap 12 externally exhibits no hold down features and is smooth. Lap 12 comprises a domed top portion 14 and an annular skirt 16 depending therefrom which together define a hollowed interior. The domed portion is preferably of constant thickness. The lap of the invention is securely, reliably, and in a failsafe manner, retained from the inside preferably, on a lap tower (support) 18. Lap tower (support) 18 is supported by a carrier (support) 20 that is securable to a machine housing (not shown). Also partially visible in FIGS. 1 and 2 is an actuator 22 the balance of which is obscured under carrier 20 and which serves to actuate means for retaining lap 12 to the support, as described more fully hereinbelow.

Figure 3:
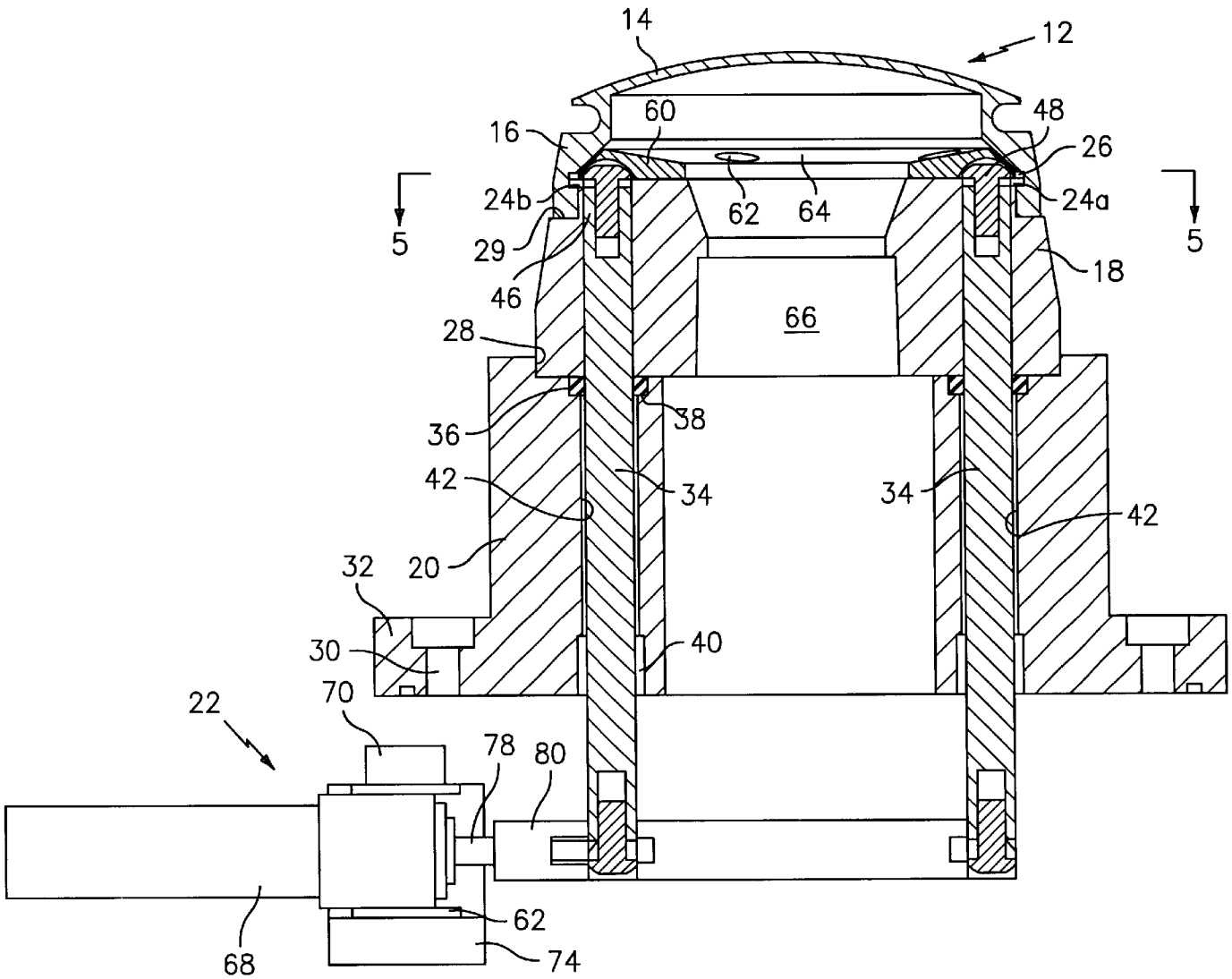
FIG. 3 is a cross-section view of the invention taken along section line 3—3 in FIG. 2.
Figure 4:
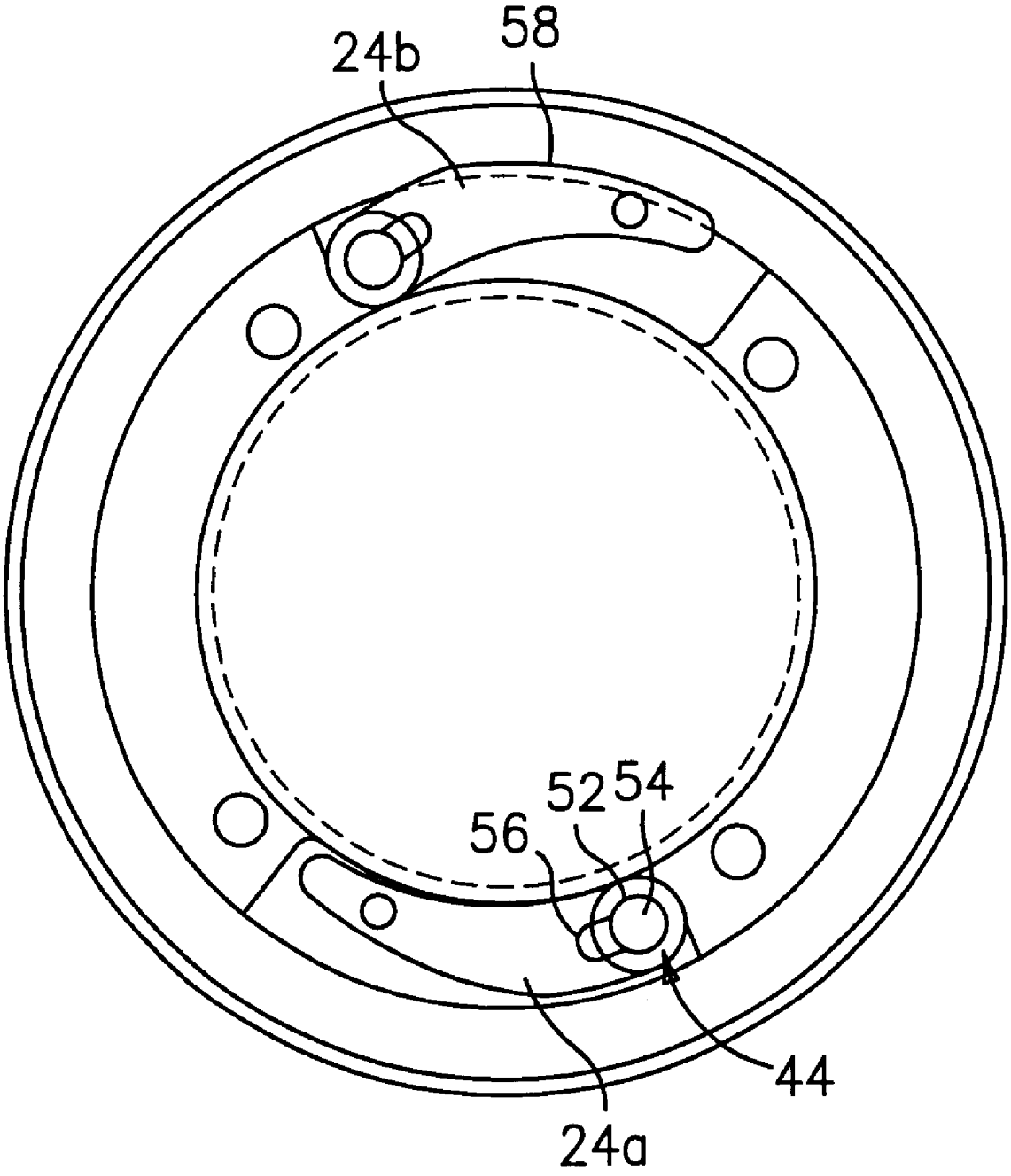
FIG. 4 is a top plan view of a lap tower or the lapping device of FIG. 1 with the lap removed.
Figure 5:
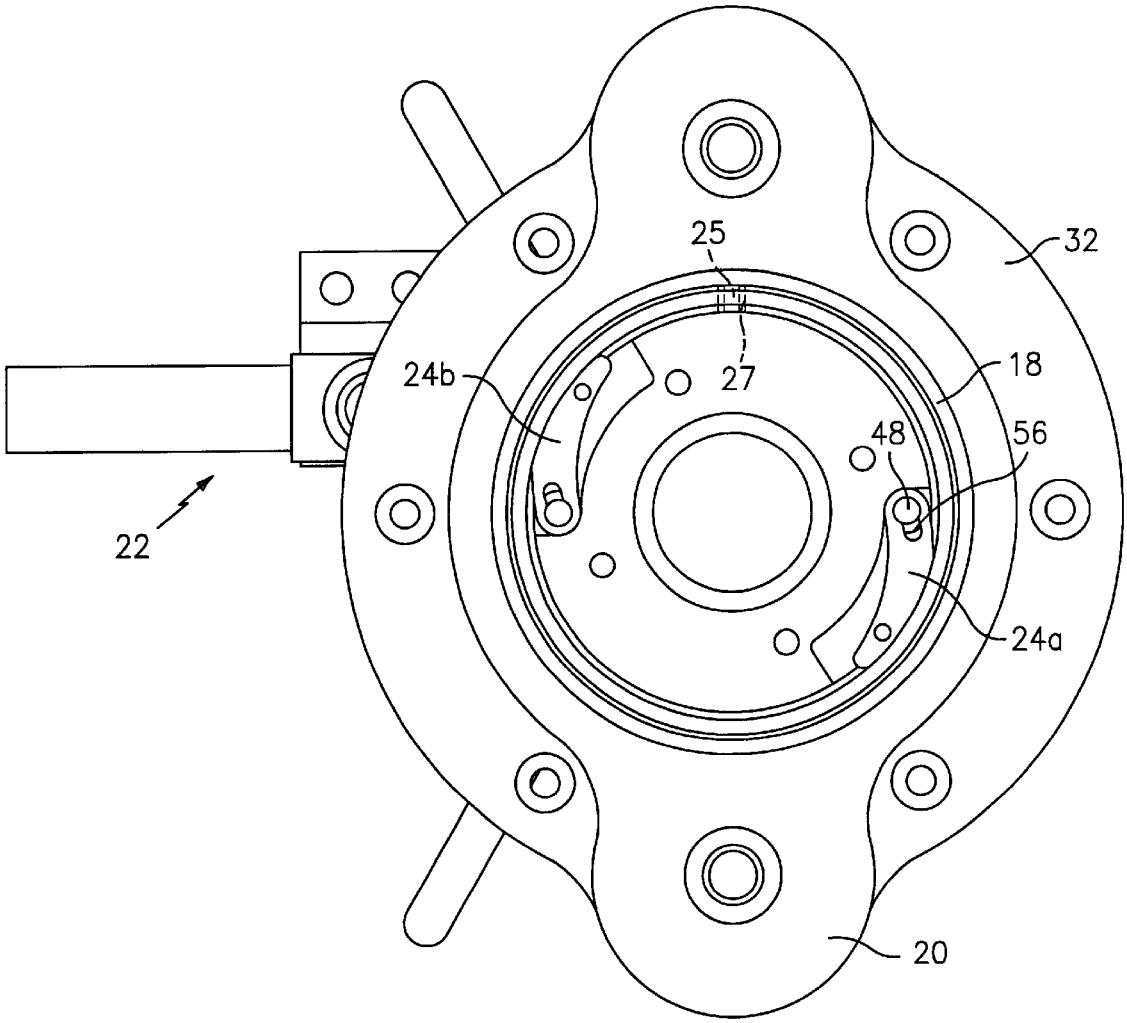
FIG. 5 is a cross-section view of the invention taken along section line 5—5 in FIG. 3.

Referring to FIG. 3 which is a cross section view of the invention taken along section line 3—3 in FIG. 2, FIG. 4 which is a schematic top view of lap tower 18 and FIG. 5 which is a cross-section view of FIG. 3 taken along section line 5—5 in FIG. 3, the operational components of the invention are addressed. Each lap 12 (the invention provides for a plurality of laps to be attached), individually, is secured to a lap tower 18 (preferably a plastic material) by a pair of blades 24*a* and 24*b*. It is important to note that in FIG. 4, blade 24*a* is illustrated in the retracted position while blade 24*b* is illustrated in the engaged position. The engaged position is the failsafe position and the one where lap 12 is secured to tower 18. Blades 24*a* and 24*b*, when in the 24*a* position, are received in a groove 26 which is cut in the hollowed interior of lap 12, radially in skirt 16. Lap 12 then sits flush on top of tower 18. Tower 18 in turn is received in a recess 28 of carrier 20 which then is fastened to a machine housing (not shown) by fasteners which pass through bolt holes 30 in a flange 32.

Blades 24*a* and 24*b* are actuated by shafts 34 which extend though tower 18 and carrier 20. Since tower 18 is in one embodiment (shown) plastic, bushings are not needed. In carrier 20 however it is preferable to apply a seal 36 in a seal bore 38 and a bushing (not shown) in a bushing bore 40. Preferably the bushing material is bronze. The bushing and seal maintain an aligned position for shafts 34 in clearance bores 42 in carrier 20. Shafts 34 extend below carrier 20 to be accessed by linkage to one of a number of actuators that are possible i.e. mechanical, hydraulic, electromechanical, electrical and pneumatic, with pneumatic being preferred.

Figure 6:
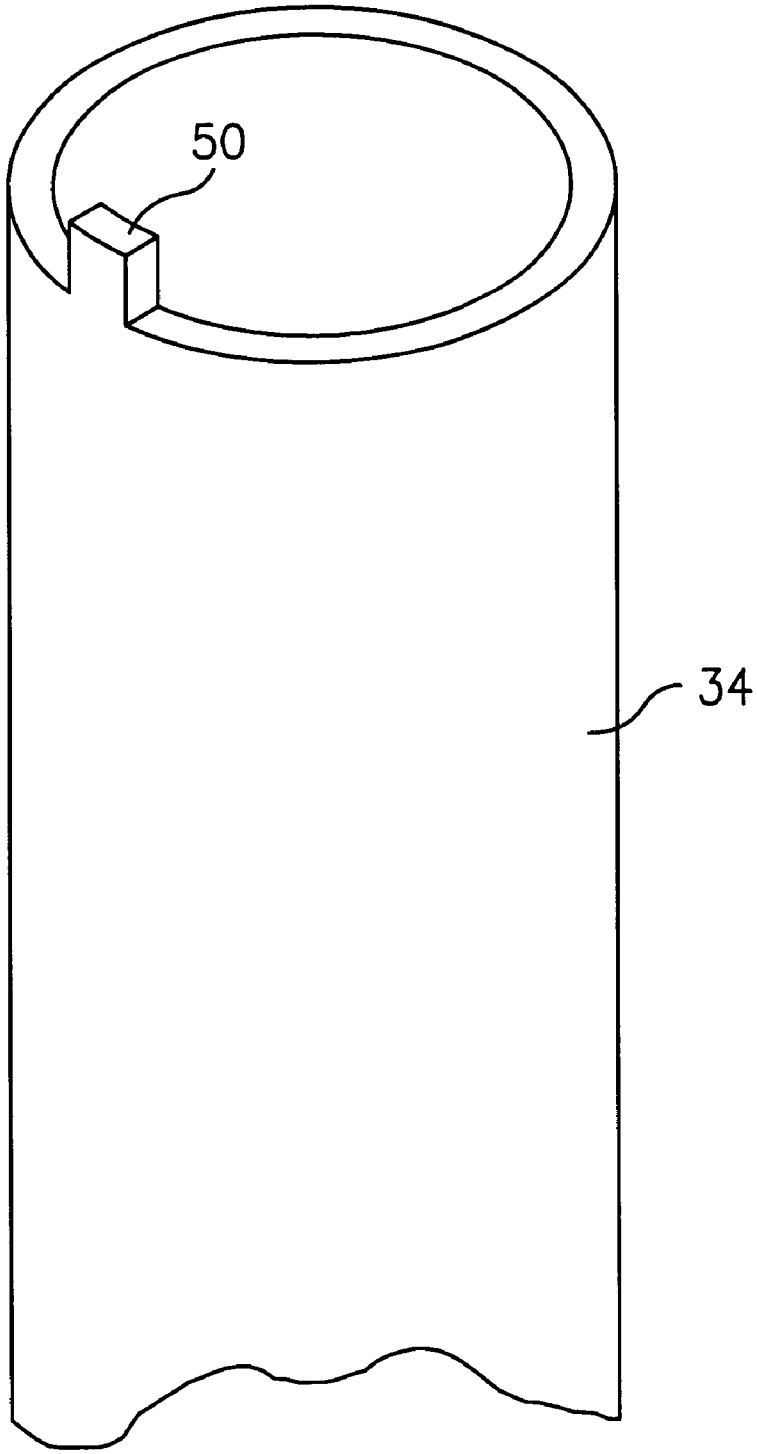
FIG. 6 is a schematic illustration of a single castellation on shafts of the lapping device as shown in FIG. 3.

Referring specifically to FIG. 4, blades 24*a* and 24*b* are attached fixedly at one end 44 thereof to an upper end 46 of shafts 34 by preferably a threaded fastener 48. Threaded fasteners are preferred to allow for disassembly if necessary. At the upper end 46 of shafts 34 are a single castellation 50 illustrated in FIG. 6 schematically. As can be seen in FIG. 4, each blade 24 includes a keyhole 52 comprising a fastener bore 54 and a dependent slot 56. Slot 56 is provided to receive castellation 50 and prevents turning of blades 24 relative to their respective shafts 34, once each blade 24 is fastened thereto with appropriate fasteners 48. In the fastened condition, rotary movement applied to shafts 34 causes a radially outward shift in position for blades 24. The degree to which such shaft is desired and intended to rotate can be ascertained by comparing the position of blade 24*a* with that of blade 24*b* in FIG. 4. It should also be appreciated that a curve 58 of fingers 24*a* and 24*b* is preferably matched to the curvature of groove 26 in lap 12 to ensure a solid engagement and reliable retention.

In order that shafts 34, do not migrate upwardly through tower 18, a cap ring 60 (annular) is positioned over the blades and is secured to the tower 18 with preferably threaded fasteners (not shown) which extend through openings 62. It should be noted that an upper surface 64 of cap ring 60 is beveled inwardly. This helps to return water, used to heat or cool lap 12 from the interior thereof, to a central drain port 66.

Figure 7:
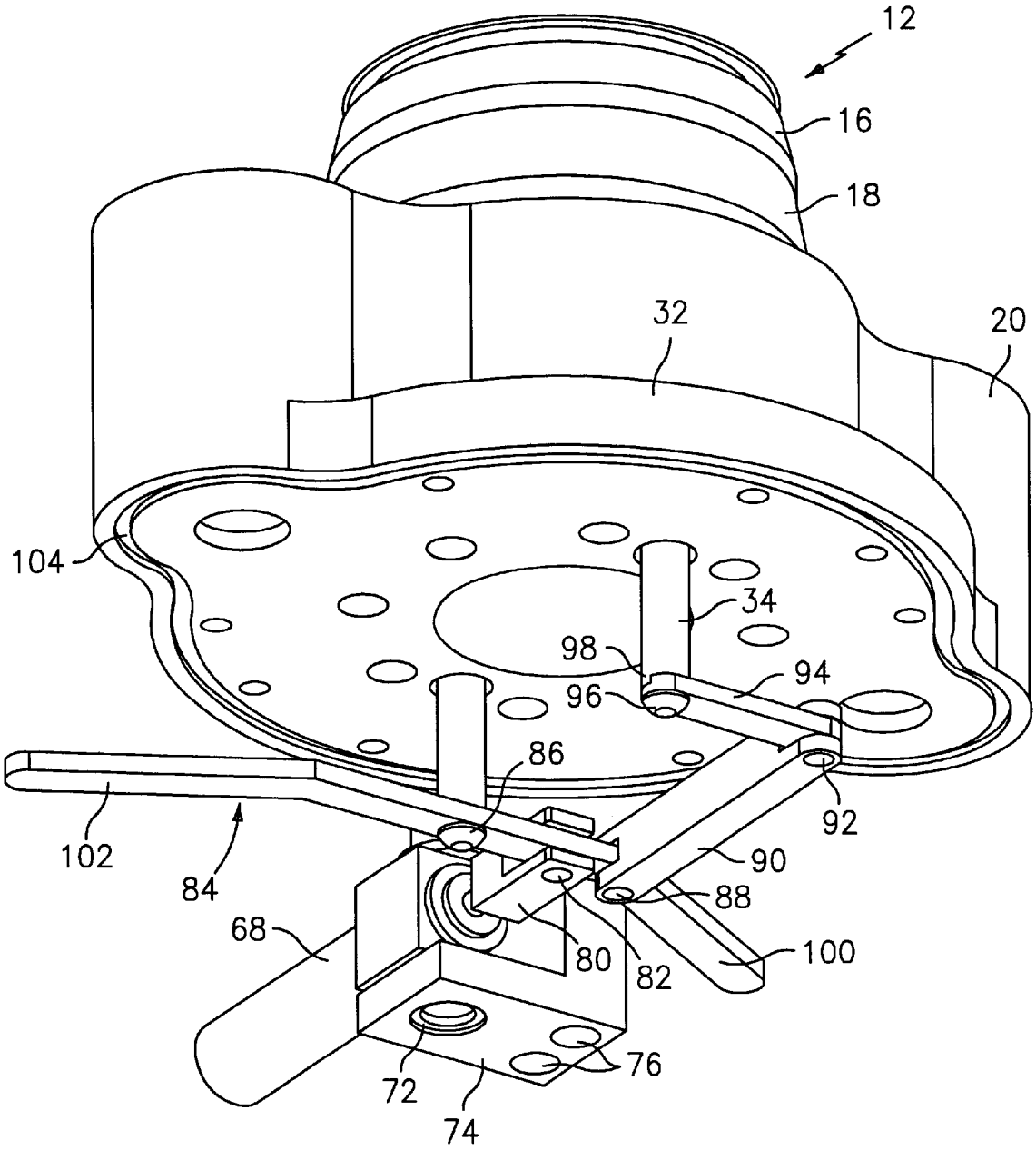
FIG. 7 is a bottom perspective view of the lapping device of FIG. 1 illustrating an actuation linkage arrangement preferred for the invention.
Figure 8:
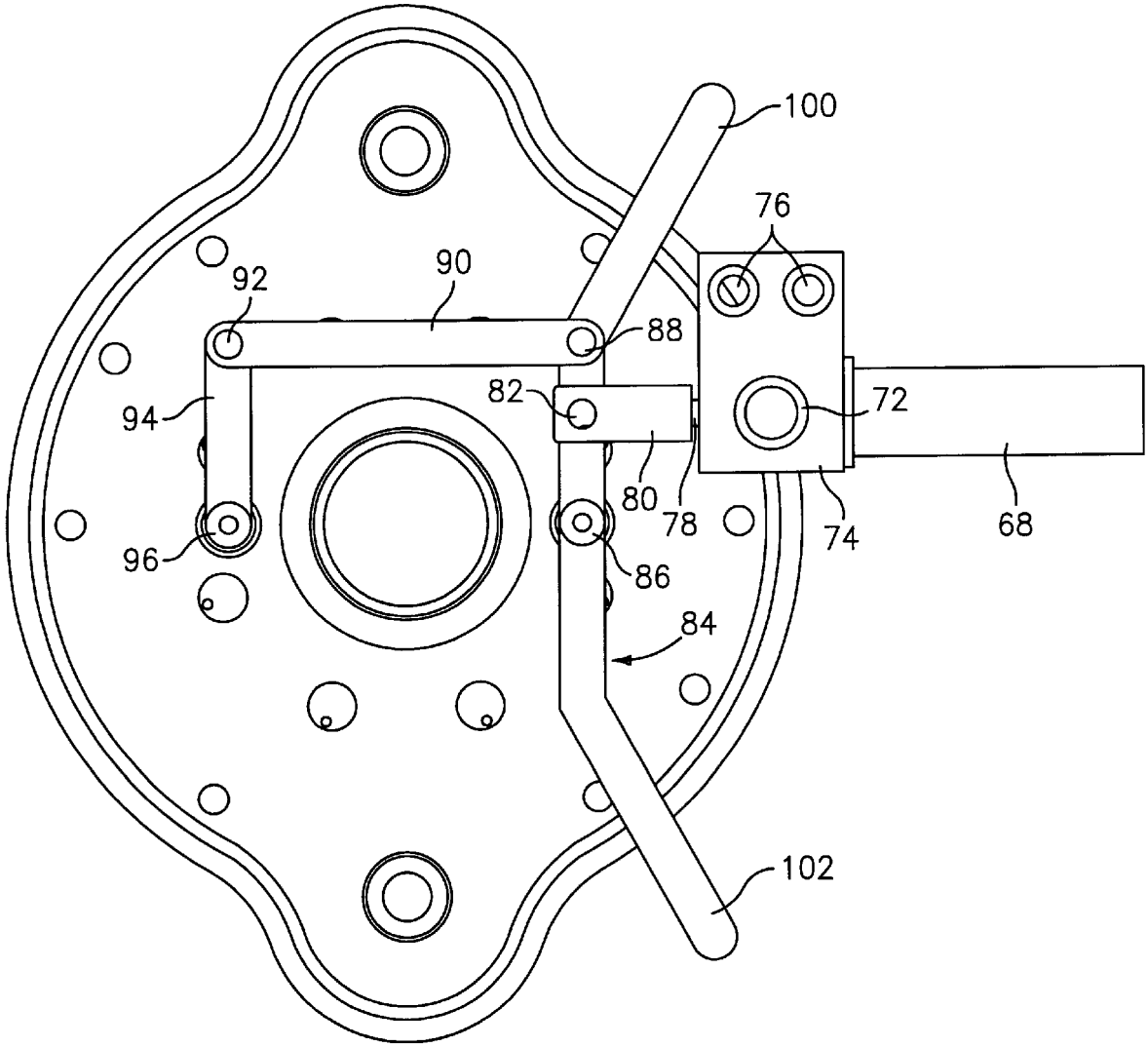
FIG. 8 is a bottom plan view of the lapping device of FIG. 1.

Turning now to the actuator 22 of blades 24*a* and 24*b*, rotational movement is imparted to shafts 34, referring to FIGS. 3, 7 and 8, by preferably a pneumatic drive 68 which is pivotally mounted through a bushing 70 to the housing (not shown) and a bushing 72 which rides in a frame section 74 that itself bolts to the housing. Frame section 74 bolts through openings 76. The pneumatic drive includes a drive shaft 78 which at a distal end from the drive, includes a clevis 80. Clevis 80 is connected via a clevis pin 82 to an actuator arm 84 which is fixedly connected by threaded a fastener 86 to one shaft 34. Actuator arm 84 is further connected by a pivot pin 88 to a link 90 which connects via a pin 92 to a radius arm 94 which in turn is connected fixedly by a fastener 96 to the other shaft 34. In order to prevent relative rotational movement between radius arm 94 and shaft 34, and actuator arm 84 and shaft 34, a single castellation is provided on each shaft. In FIG. 7, one of the castellations is visible and is identified as 98. A spring is preferably placed in operable contact with the driver assembly to maintain the assembly in the position where the lap is locked onto tower 18. The spring is not shown but could bear against any of the various linkage members or could be internal to the pneumatic drive so long as the bias tends to urge the drive in a direction opposite the actuation drive direction and into a position where blades 24*a* and 24*b* are engaged with groove 26. Thus, when a lap 12 is to be removed, the actuator 22 is actuated overcoming the spring bias in the opposite direction and unlocks the blades 24 from the lap 12. With the blades unlocked (disengaged from the lap groove 26) the lap easily is lifted off of tower 18. Laps could be automatically removed and replaced using a pick and place machine with a vacuum cup at the working end thereof which has been created by Gerber Coburn. The cup being selectively energized and deenergized.

In the event that power to the drive 68 is lost, the device is in the failsafe or locked mode. The device can still be actuated manually by a user gripping actuation arm grips 100 and 102 and moving them to overcome the spring bias of the system.

Referring back to FIG. 5, another important feature of the invention is illustrated. It is desireable to provide pin 25 which extends radially outwardly from tower 18 to positively locate lap 12. While blades 24, secure lap 12 from moving in the z-axis i.e. prevent removal of lap 12 from tower 18, they do not prevent rotation about the z-axis. For cylindrical laps, rotation about the z-axis causes significant axis problems in a lens produced thereby and that lens would necessarily be defective. Pin 25 prevents rotation about the z-axis and so produces accurate axis for cylindrical correction. Lap 12 is simply and easily engaged with pin 25 by notch 27. Notch 27 is preferably machined into lap 12 from a bottom edge 29 thereof (see FIG. 5 for location). In one embodiment the notch 27 is flared at a bottom portion thereof to allow for some tolerance in aligning lap 12. As lap 12 moves into full engagement with tower 18, pin 25 moves into the indexed position of notch 27 and the lap 12 is aligned properly and prevented from rotational movement about the z-axis.

Finally, FIG. 7 provides a view of a seal groove 104 that receives a seal such as an o-ring to pressure tightly seal the junction between the carrier 20 and the housing (not show). This is advantageous for other aspects of the system of which the invention forms a part.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A lap retainer system comprising:

a lap support;

a shaft rotatably passing through said support;

a blade attached to said shaft and rotatable therewith, said blade being configured to be received in an inwardly facing groove on a separate lap by said blade moving outwardly from a central axis of said lap support to secure the separate lap to the lap support; and an actuation system operably coupled with said shaft to rotate said shaft and thereby rotate said blade.

2. A lap retainer as claimed in claim 1 wherein said shaft is two shafts, each shaft having a blade attached thereto, both of said blades being engageable with said lap.

3. A lap retainer as claimed in claim 2 wherein said two shafts are interconnected with said actuation system.

4. A lap retainer as claimed in claim 3 wherein said actuation system interconnects said two shafts by linkage to a driver, said linkage translating motion of said driver to rotate said two shafts.

5. A lap retainer as claimed in claim 1 wherein said actuation system is one of hydraulically, pneumatically, electrically, electromechanically and mechanically driven.

6. A lap retainer as claimed in claim 1 wherein said actuation system is manually operable.

7. A lap retainer as claimed in claim 1 wherein said blade is keyed to said shaft.

8. A method for retaining a lap comprising:

supporting a lap on a lap support, said lap having an annular groove on an internal aspect thereof; and engaging said groove with a blade disposed under said lap when supported by said support.

9. A method as in claim 8 wherein said engaging comprises:

rotating a shaft extending through said support and into connection with said blade, to move at least a part of said blade to a position radially outwardly from an unrotated position.

10. A method as in claim 9 wherein said rotating is by spring bias and said unrotated position is achieved by operating an actuator to overcome said spring bias.

* * * * *